US005215792A

United States Patent [19]

Miller

[11] Patent Number: 5,215,792

[45] Date of Patent: Jun. 1, 1993

[54] INFORMATIVE CARD MADE OF SHEET METAL

[75] Inventor: C. Daniel Miller, Rockford, Ill.

[73] Assignee: J. L. Clark, Inc., Rockford, Ill.

[21] Appl. No.: 618,226

[22] Filed: Nov. 26, 1990

[51] Int. Cl.[5] ..... B42D 15/02

[52] U.S. Cl. ..... 428/14; 40/124.1; 229/92.8

[58] Field of Search ..... 40/124.1; 229/92.8; 206/44 B; 273/293, 295, 296; 428/13, 14

[56] References Cited

U.S. PATENT DOCUMENTS 1,117,085 11/1914 Potts ..... 40/124.1
3,322,299 5/1967 Foster ..... 220/306
4,291,798 9/1981 Transport ..... 40/124.1 X
4,309,835 1/1982 Naeve ..... 40/124.1 X
4,515,838 5/1985 Miyajima ..... 428/14

*Primary Examiner*—Henry F. Epstein
*Attorney, Agent, or Firm*—Leydig, Voit & Mayer

[57] ABSTRACT

An informative card such as a baseball trading card is made of sheet metal and is formed so as to be free of sharp edges and pointed corners. Flattened hems around the periphery of the rear side of the card define a raised framing border around indicia which is printed on the rear side. The front side of the card is displaced rearwardly inboard of the hems so as to leave raised peripheral front ledges which define a raised and substantially uninterrupted border around indicia on the front side.

13 Claims, 4 Drawing Sheets

INFORMATIVE CARD MADE OF SHEET METAL

BACKGROUND OF THE INVENTION

This invention relates generally to an informative card and, more particularly, to a card such as a baseball trading card.

Conventionally, such cards are made of paperboard or other paper-like material and contain a photograph of a baseball player on the front side. Career statistics or other data usually are printed on the rear side.

In most cards, a border of uniform color is printed around the peripheral margin of the front side of the card and "frames" the photograph of the player. A similar border may be printed around the margin of the rear side of the card.

From the standpoint of permanency and enhancement of appearance it would be desirable to provide a lithographed sheet metal card. A raw piece of sheet metal, however, contains sharp edges and corners which make the piece unsafe for use as a trading card or the like.

SUMMARY OF THE INVENTION

The primary aim of the present invention is to provide an informative card which is made of a thin piece of sheet metal and which is free of raw edges and sharp corners.

Another object of the invention is to provide a sheet metal card having a virtually uninterrupted raised border which defines a frame around the printed matter on the front side of the card.

Still another object is to provide a card having a raised border on its rear side for defining a frame around the printed matter on the rear side.

The invention also resides in the novel method of converting a raw piece of sheet metal into a card having protected edges and corners and having raised borders on each side.

These and other objects and advantages of the invention will become more apparent from the following detailed description when taken in conjunction with the accompanying drawings.

DETAILED DESCRIPTION OF THE PREFERRED EMBODIMENT

Figure 1:
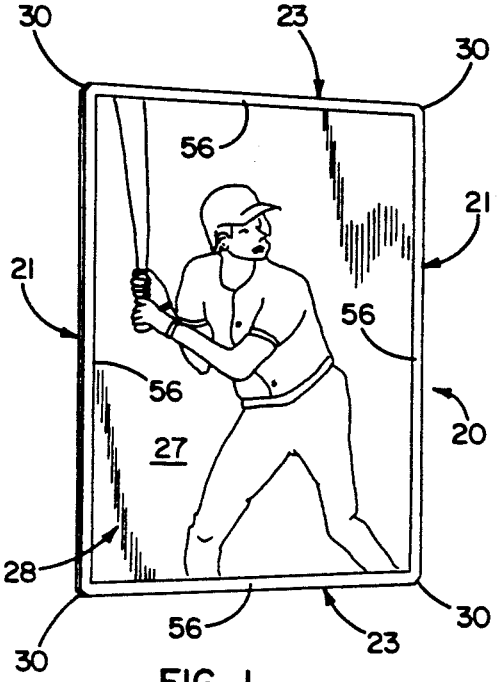
FIG. 1 is a front perspective view of a new and improved informative card made of sheet metal and incorporating the unique features of the present invention.
Figure 2:
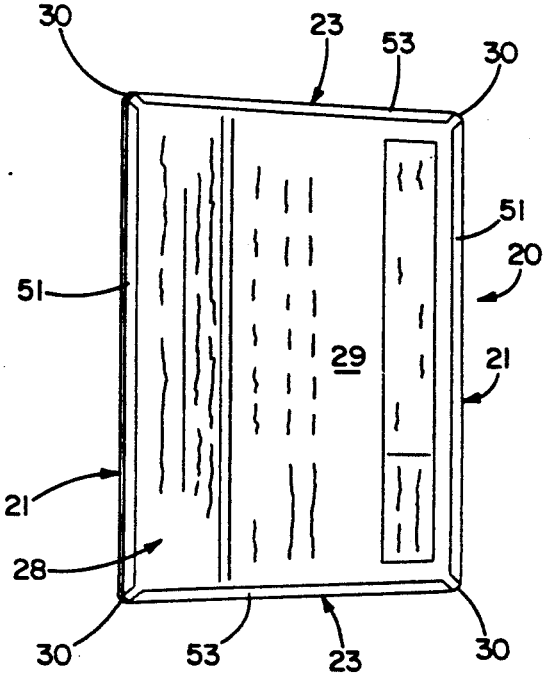
FIG. 2 is a rear perspective view of the card.
Figure 3:
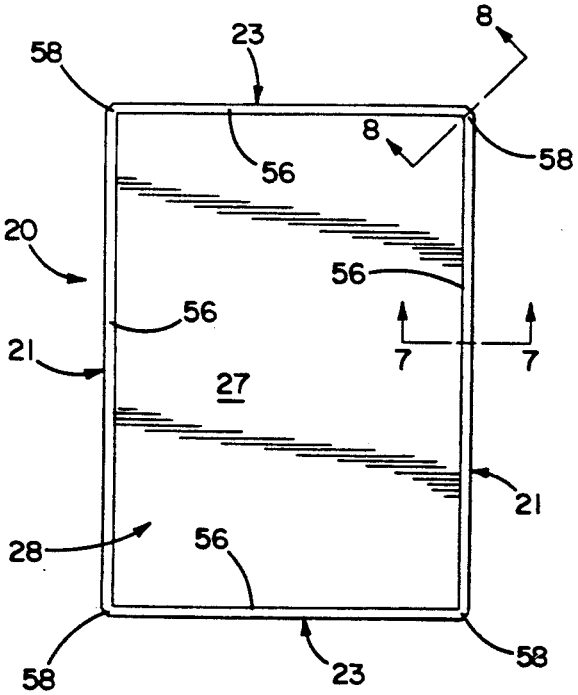
FIG. 3 is a front view of the card.
Figure 4:
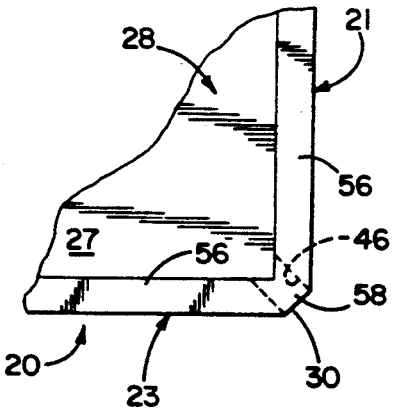
FIG. 4 is an enlarged front view of one corner portion of the card shown in FIG. 3.
Figure 5:
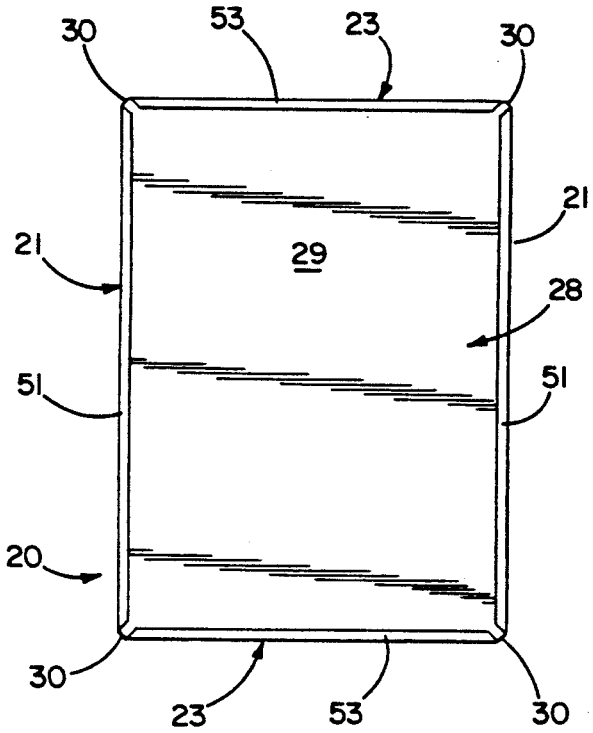
FIG. 5 is a rear view of the card.

For purposes of illustration, the invention has been shown in the drawings as embodied in an informative card 20. In this specific instance, the card has been shown as being a baseball trading card but it will be appreciated that other type of information could be printed on the card.

The card is generally flat and rectangular and includes two parallel long edge portions 21 and two parallel shorter edge portions 23 which extend at right angles to the long edge portions. Printed on the front side 27 of the flat body 28 of the card is a photograph of a baseball player. Statistics or other indicia are printed on the rear side 29 of the card. The card is of conventional size and thus has a length of 3½" and a width of 2½".

In accordance with the present invention, the card 20 is made from a piece of sheet metal which is formed in such a way as to eliminate the presence of sharp corners and exposed raw edges. Moreover, the metal preferably is formed so as to define a raised and virtually uninterrupted border around the margins of the front side 27 of the body 28 of the card so as to "frame" the photograph or other indicia thereon. A raised border also is formed around the margins of the rear side 29 of the body 28 of the card and frames the indicia on the rear side.

More specifically, the card 20 is formed from a generally rectangular blank 20A (FIGS. 9 and 10) of tin plate which originally has a flat body 28A with a length of about 3⅝", a width of about 2⅝" and a thickness of about 0.008". Each of the four corners 30 of the blank is not a right angle but instead is cut away so as to slope at a 45 degree angle relative to the adjacent edges of the blank. The 45 degree corners 30 may be formed as an incident to punching the blank from a larger sheet of metal. In this particular instance, each corner 30 has a length of about 0.23".

Figure 9:
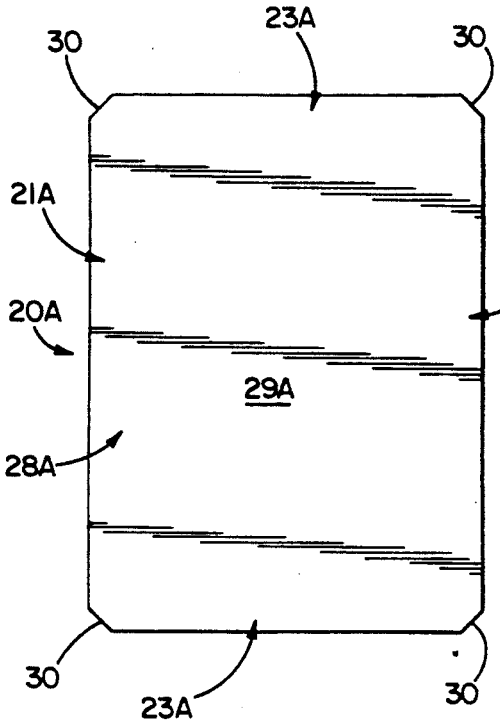
FIG. 9 is a rear view showing the first step of making the card from a piece of sheet metal.
Figure 11:
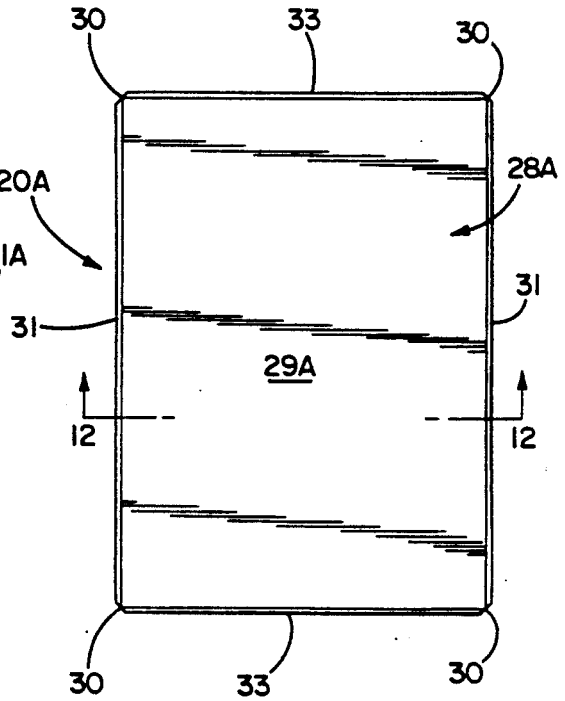
FIG. 11 is a rear view showing the next step in making the card.
Figure 10:
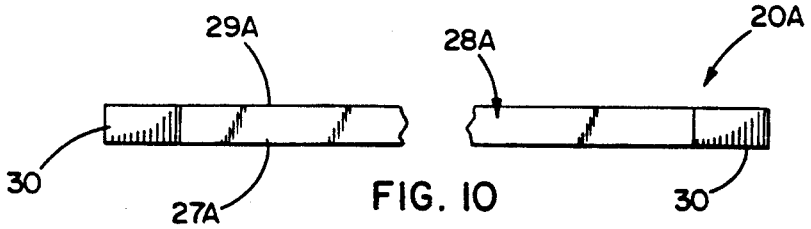
FIG. 10 is an enlarged fragmentary end view of the blank shown in FIG. 9.
Figure 12:
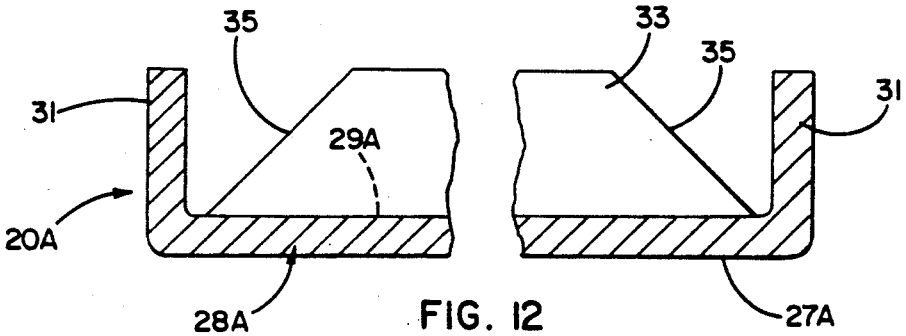
FIG. 12 is an enlarged fragmentary cross-section taken substantially along the line 12—12 of FIG. 11.

The four edge portions 21A and 23A of the blank 20A of FIGS. 9 and 10 are first bent rearwardly at an angle of 90 degrees to the rear side 29A of the blank so as to form rearwardly projecting flanges 31 and 33, respectively, as shown in FIGS. 11 and 12. When each edge portion is bent rearwardly just slightly less than one-half of each corner 30 at the end of the edge portion is also bent rearwardly and thus only a very short length of the original corner remains flat and planar. Because of the 45 degree corners 30, each edge portion may be bent rearwardly without engaging or interfering with the two adjacent edge portions at the corners of the blank. Also, the 45 degree corners 30 cause each flange to have ends 35 (FIG. 12) which slope at 45 degrees.

Herein, each flange has a height of about 1/16". As a result of the flanges, the length of the blank 20A is reduced to a standard dimension of about 3½" while the width of the blank is reduced to about 2½".

Figure 13:
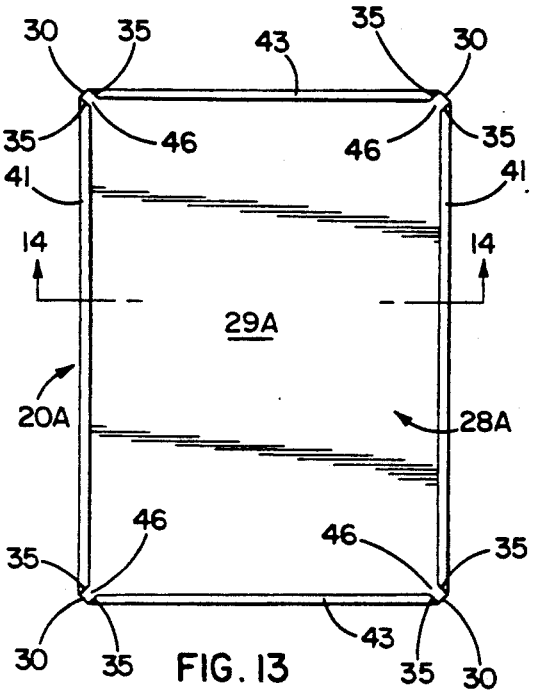
FIG. 13 is a rear view showing a subsequent step of forming the card.

Subsequently, each of the flanges 31 and 33 is bent forwardly and through another 90 degrees so as to form hems in the form of curls 41 and 43, respectively, (FIGS. 13 and 14) which are disposed face-to-face with the rear side 29A of the body 28A of the blank 20A. The bending is controlled so that the outboard side of each curl is radiused as indicated at 45 in FIG. 14. As shown in FIG. 13, the angled ends 35 of each curl are spaced from the end of each adjacent curl and such ends extend substantially perpendicular to the corners 30. The spaces between the ends of adjacent curls have been indicated by the reference numeral 46.

By virtue of the curls 41 and 43, the initially sharp edges of the blank 20A are converted to the radiused surfaces 45. Also, the remaining flat portions of the 45 degree corners 30 are short in length and do not define sharp points. Thus, the danger of the consumer suffering a cut or a puncture wound is reduced. The curls define a border around the margins of the rear side 29A of the body 28A of the blank 20A and thus "frame" the information printed on that side within the border. If desired, the blank 20A as thus converted may be used as the ultimate information card 20, and particularly if the curls are pressed into face-to-face contact with the rear side 29A of the body 28A as described subsequently.

Figure 15:
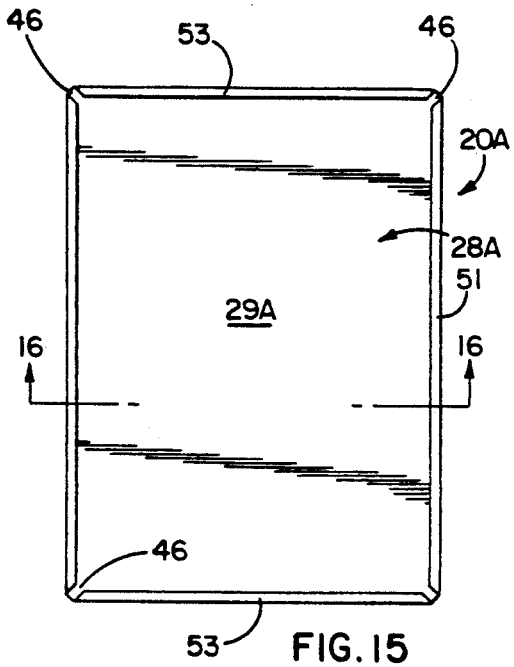
FIG. 15 is a rear view showing the final step of forming the card.
Figure 16:
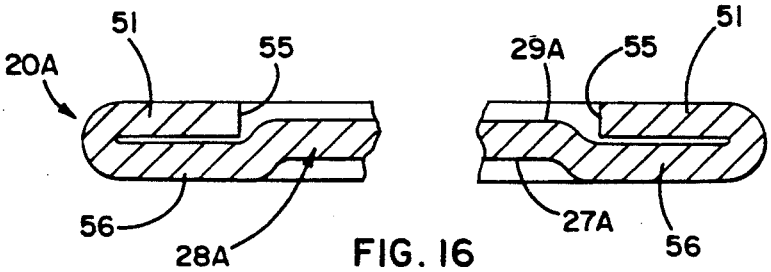
FIG. 16 is an enlarged fragmentary cross-section taken substantially along the line 16—16 of FIG. 15.

Preferably, however, the blank 20A is further refined to form a border or frame on the front side 27A of the blank and to further reduce sharp edges. For this purpose, the initial hems formed by the curls 41 and 43 are flattened so as to form flattened hems 51 and 53, respectively, (FIGS. 15 and 16). As an incident to forming the curls into flattened hems, that rectangular portion of the body 28A located inboard of the hems is pressed rearwardly with such force as to displace the rectangular portion rearwardly relative to the hems. As a result, a sunken depression or recess 55 (FIG. 16) is formed in the rear side 29A of the body 28A beneath the inboard portion of each hem along the entire span thereof and accommodates part of the thickness of the inboard portion of the hem. Because the aforementioned rectangular portion of the body is displaced rearwardly relative to the inboard edges of the hems, a raised ledge 56 is left at the margin of the front side 27A of the body 28A opposite each hem. The inboard portion of each ledge 56 is located along and opposite to the recess 55 while the outboard portion of the ledge is coplanar with the inboard portion.

Figure 14:
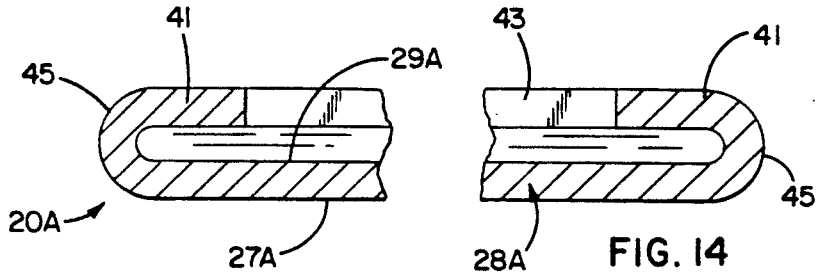
FIG. 14 is an enlarged fragmentary cross-section taken substantially along the line 14—14 of FIG. 13.
Figure 14A:
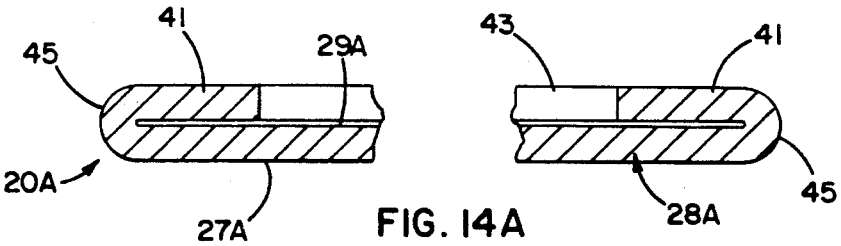
FIG. 14A is a view similar to FIG. 14 but shows the next-to-last step of forming the card.

To explain further, assume that the original blank 20A of FIGS. 9 and 10 has a thickness of 0.008". To form the hems 51 and 53, the curls 41 and 43 of FIG. 14 are backed by a flat anvil located at the rear side of the blank. The entire forward side of the blank then is pressed forwardly to force the curls against the anvil. When each of the curls 41 and 43 is flattened from the plane of FIG. 14 to a plane against the rear side 29A of the body 28A but with no metal deformation as shown in FIG. 14A, the total thickness of the blank through each curl or hem is 0.016", that is to say, a thickness of 0.008" resulting from the body 28A of the original blank and a thickness of 0.008" resulting from the hem. At this intermediate stage, the forward side 27A of the blank remains flat and planar while the rear side of the hem is spaced 0.008" from the rear side 29A of the blank. If the blank 20A were left at this intermediate stage, the blank would be suitable for use as an information card but such card would lack a front border. Also, the full thickness of the edges of the hems would be exposed.

Accordingly, and in keeping with the preferred embodiment of the invention, the central rectangular portion of the body 28A inboard of the hems 51 and 53 is displaced rearwardly from the plane of FIG. 14A to the plane of FIG. 16 while the hems are backed by an anvil or the like, the rearward displacement in this particular instance being a distance of 0.004". As a result of such displacement, the recess 55 is formed beneath each hem and receives 0.004" thickness of the hem so that the rear side of the hem projects only 0.004" from the rear side 29A of the body 28A. Also, each ledge 56 projects forwardly 0.004" from the forward side 27A of the body by virtue of the central rectangular portion of the body being displaced rearwardly.

Figure 6:
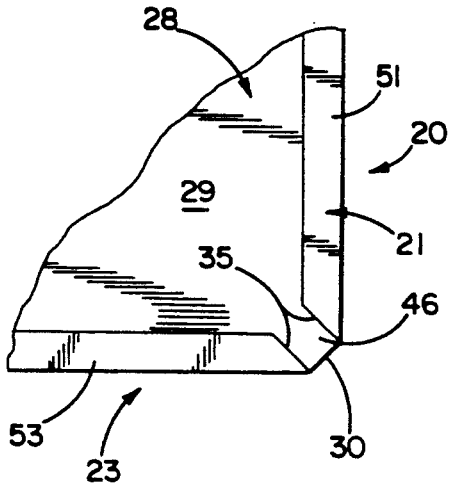
FIG. 6 is an enlarged rear view of one corner portion of the card shown in FIG. 5.
Figure 7:
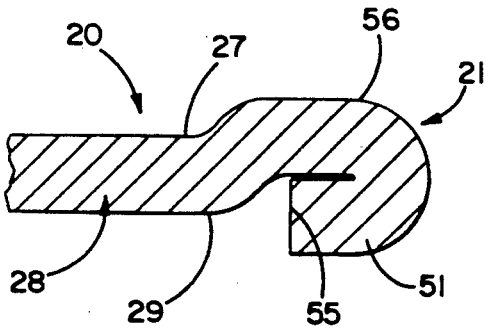
FIGS. 7 and 8 are enlarged fragmentary cross-sections taken substantially along the lines 7—7 and 8—8, respectively, of FIG. 3.
Figure 8:
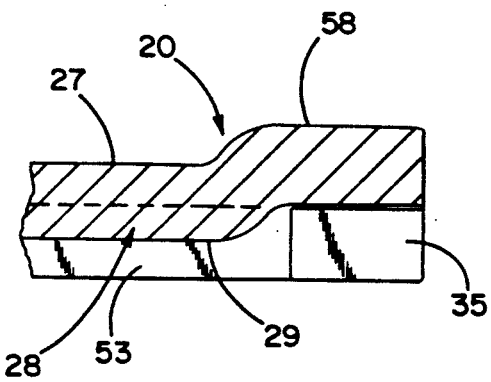

The card 20 resulting from the process described above is shown in detail in FIGS. 1 to 8. On the rear side 29 of the card, flattened hems 51 and 53 extend along the edge portions 21 and 23, respectively, and form a raised framing border around the indicia printed on the rear side of the body 28. The hems are raised from the rear side of the body by a distance of about 0.004" and lie within sunken recesses 55 (FIG. 7) formed in the rear side of the body. As shown in FIG. 6, the ends 35 of the hems extend at a 45 degree angle relative to the length of the hems, extend perpendicular to the 45 degree corners 30 and are separated from one another by the spaces 46. The free edge of each hem lies flat against the rear side 29 of the body 28 and since one-half of the thickness of the hem is sunk into the recess 55, the edge of the hem is not likely to cut fingers.

The front side 27 of the card 20 includes raised ledges 56 (FIGS. 3, 4 and 7) along each of the edge portions 21 and 23 opposite the hems 51 and 53 and also includes raised ledges 58 (FIGS. 3, 4 and 8) overlying the spaces 46 adjacent the corners 30. Because the ledges are defined by displacing the central rectangular portion of the body 28 rearwardly, the ledges are uninterrupted and define a continuous raised framing border around the front side 27 of the body, the border projecting about 0.004" from the front side. Accordingly, the photograph on the front side is attractively framed by a raised surface and thus the photograph may be highlighted to a greater degree than is the case when a border of contrasting color is simply printed on a flat substrate.

Progressive tooling may be used to make the card 20 on a high speed basis with the blank 20A first being stamped from a large sheet of metal. After the flanges 31 and 33 have been bent rearwardly from the blank by a suitable tool, another tool may be used to form the curls 41 and 43. Thereafter, a tool coacts with an anvil to flatten the curls 41 and 43 so as to form the flattened hems 51 and 53. Finally, a coining tool coacts with a die to displace the central rectangular portion of the body 28 rearwardly and to thereby form the recesses 55 and to leave the ledges 56 and 58.

From the foregoing, it will be apparent that the present invention brings to the art a new and improved informative card 20 which is made of sheet metal, which may be attractively lithographed but which is free of sharp edges and pointed corners. The ledges 56 and 58 define a raised and uninterrupted border on the front side 27 of the card while the hems 51 and 53 define a raised frame on the rear side 29 of the card.

I claim:

1. An informative card made of a substantially flat and generally rectangular sheet of metal having a front side and a rear side, having a pair of parallel first edge portions, having a pair of parallel second edge portions extending substantially perpendicular to said first edge portions, and having four corners, there being one corner between adjacent edge portions with each corner extending at an angle of about 45 degrees relative to each of such edge portions, each of the edge portions of the rear side of said sheet being defined by a folded hem having a radiused outer margin, having an uninterrupted straight inner edge, having a forwardly facing surface defined by the rear side of said sheet, and having a rearwardly facing surface defined by the front side of said sheet, and indicia on the front side of said sheet.

2. An informative card as defined in claim 1 in which each of each hem is located adjacent one of said corners and extends substantially perpendicular to such corner, adjacent ends of adjacent hems being spaced from one another.

3. An informative card as defined in claim 2 further including sunken depressions extending along the edge portions of said sheet at the rear side thereof, portion of said hems lying in said depressions.

4. An informative card as defined in claim 3 further including raised ledges extending along the edge portions of said sheet at the front side thereof and having portions disposed in front of said depressions, said ledges defining a border around said indicia.

5. An informative card as defined in claim 4 further including raised ledges at the corners of the front side of said sheet and located between the ledges which extend along said edge portions.

6. An informative card made of a substantially flat and generally rectangular sheet of metal having a front side and a rear side, having a pair of parallel first edge portions, and having a pair of parallel second edge portions extending substantially perpendicular to said first edge portions, each of said edge portions being defined by a depression in the rear side of said sheet, by a ledge on the front side of said sheet and by a folded hem having a portion lying in said depression, said ledges defining a generally rectangular border on the front side of said sheet, and indicia on the front side of said sheet within said border.

7. An informative card as defined in claim 6 in which said hems define a second generally rectangular border on the rear side of said sheet, and indicia on the rear side of said sheet within said second border.

8. An informative card as defined in claim 6 in which said sheet includes four corners, there being one corner between each first edge portion and each adjacent second edge portion and extending at an acute angle relative to said edge portions.

9. An informative card made of a substantially flat and generally rectangular sheet of metal having a front side and a rear side, having a pair of parallel first edge portions, having a pair of parallel second edge portions extending substantially perpendicular to said first edge portions, and having four corners, there being one corner between each first edge portion and each adjacent second edge portion and extending approximately at a 45 degree angle relative to each of such edge portions, each of said edge portions being defined by a sunken depression in the rear side of said sheet, by a raised ledge on the forward side of said sheet and by a hem having a portion lying in said depression and formed by folding said sheet rearwardly upon itself, said raised ledges defining a generally rectangular border on the front side of said sheet, and indicia on the front side of said sheet within said border.

10. An informative card as defined in claim 9 further including raised ledges at the corners of the front side of said sheet and located between the ledges which extend along said edge portions, adjacent ledges adjoining one another whereby said border is continuous.

11. An informative card as defined in claim 10 in which said hems define a second generally rectangular border on the rear side of said sheet, and indicia on the rear side of said sheet within said second border.

12. An informative card as defined in claim 9 in which each of said hems includes two ends located adjacent two of said corners, the end of each hem extending substantially perpendicular to the corner located adjacent such end.

13. An informative card as defined in claim 12 in which the ends of adjacent hems are spaced from one another.

* * * * *